US005382173A

United States Patent [19]

Brown et al.

[11] Patent Number: 5,382,173

[45] Date of Patent: Jan. 17, 1995

[54] ELECTRICAL CONNECTOR

[75] Inventors: Gregory S. Brown, Ventura; Frank Quach, Northridge; Jose Silva, Reseda, all of Calif.

[73] Assignee: Trompeter Electronics, Inc., Westlake Village, Calif.

[21] Appl. No.: 115,978

[22] Filed: Sep. 1, 1993

[51] Int. Cl.[6] ..... H01R 29/00

[52] U.S. Cl. ..... 439/188; 439/620; 200/51.09

[58] Field of Search ..... 200/51.09, 51.1, 51 R; 439/188, 578, 579, 580, 581, 582, 583, 584, 585, 620

[56] References Cited

U.S. PATENT DOCUMENTS

| | | | |
|---|---|---|---|
| 4,988,307 | 1/1991 | Muzslay | 439/188 |
| 5,073,123 | 12/1991 | Birch et al. | 439/188 |
| 5,076,797 | 12/1991 | Moulton | 439/188 |
| 5,147,992 | 9/1992 | Eriksen et al. | 439/188 X |

*Primary Examiner*—Khiem Nguyen

*Attorney, Agent, or Firm*—Ellsworth R. Roston; Charles H. Schwartz

[57] ABSTRACT

A member has two (2) spring arms each movable between first and second positions. Each spring arm is normally biased to a first position and is movable to a second position. Each spring arm has at its free end an insulator and a conductor disposed on the insulator. The insulator isolates the conductor electrically from the associated spring arm. An electrical lead is connected between the conductors. In the first position of the spring arms, the electrical conductors engage individual ones of a pair of probes and establish common probe potentials. Each probe is disposed coaxially in an insulator in an individual one of a pair of electrical connectors and the insulator is disposed coaxially in a casing in the connector. The probe extends axially beyond the insulator and the casing in each connector so that the associated electrical conductor is able to engage the probe in that connector in the first position of the spring arm. This causes the two (2) connectors to be connected in series in this first relationship. When the spring arm associated with an individual one of the connectors is moved to a second position, the electrical conductor engages a first terminal in an impedance (e.g. a resistor) having a second terminal common with the connector casings to establish a reference potential (e.g. ground). In this second relationship, the electrical connector forms a circuit which includes the moved conductor, the impedance and the casing ground.

24 Claims, 2 Drawing Sheets

ELECTRICAL CONNECTOR

This invention relates to electrical connectors. More particularly, the invention relates to an assembly in which two (2) electrical connectors are disposed in a common housing and in which (a) the two (2) connectors are in series in a first operative relationship, (b) one of the connectors provides a continuous circuit with an impedance in a second operative relationship and (c) the other connector provides a continuous circuit with the impedance in a third operative relationship. The invention especially relates to electrical connectors which are able to operate reliably at high frequencies in the order of hundreds of megahertz in the three (3) relationships.

Electrical connectors are used in electrical systems to provide a transfer of electrical voltages and electrical currents between different parts of such systems. The electrical connectors are often coaxial. In coaxial connectors, an electrical insulation is disposed in enveloping and coaxial relationship with a probe, and a casing is disposed in enveloping and coaxial relationship with the insulator. Coaxial connectors have been used for years to connect coaxial cables.

One type of connector assembly provides two (2) coaxial connectors in a common housing. Spring arms are disposed in the housing and are normally biased to engage the probes extending in the connectors beyond the insulators and the casings. In this relationship, the two (2) connectors are in parallel.

The spring arms are individually movable to a second position. In the second position, the spring arms engage one terminal of an impedance (e.g. a resistor), the other terminal of which is common with the casings. In this second relationship, an electrical circuit is established from the probe in one of the connectors through the impedance to the reference potential such as the ground established by the connector casings. At the same time, the other connector is able to receive a voltage between its probe and its casing and to transmit this voltage (or a current) through the connector to a member displaced from the connector.

The connector assembly with the two (2) coaxial connectors disposed in a single housing provides reliable and desirable characteristics at relatively low frequencies. However, as the frequencies rise into the range of hundreds of megahertz, the electrical connectors change the characteristics of the signals. For example, square waves are formed from a fundamental frequency and a plurality of harmonics having particular amplitude and phase relationships to one another. These square wave signals are used to transmit digital data. In order to preserve the rectangular characteristics of the signals, the harmonics have to be preserved and have to be passed through the connectors in particular amplitudes and phases relative to the signals at the fundamental frequency.

It has been found that the connector assembly defined by a pair of coaxial connectors in a common housing do not preserve the characteristics of the signals at the high frequencies. This has prevented the connector assembly from passing signals with rectangular characteristics at the high frequencies. The inability of the connectors to pass the signals at the high frequencies is believed to result from the effects of large inductances produced in the spring arms and from the capacitances between these spring arms and other components in the connector assembly.

In one embodiment of the invention, a member has two (2) spring arms each movable between first and second positions. Each of the spring arms is normally biased to a first position and is movable to a second position. Each of the spring arms has at its free end an insulator and a conductor disposed on the insulator. The insulator isolates the conductor electrically from the spring arm. An electrical lead is connected between the conductors. In the first position of the spring arms, the electrical conductors engage individual ones of a pair of probes and establish a common potential with the probes.

Each of the probes is disposed co-axially in an insulator in an individual one of a pair of electrical connectors and the insulator is disposed co-axially in a casing in the connector. The probe extends axially beyond the insulator and the casing in each connector so that the associated electrical conductor is able to engage the probe in that connector in the first position of the spring arm. This causes the connectors to be connected in series in this first relationship.

When the spring arm associated with an individual one of the connectors is moved to a second position, the electrical conductor engages a first terminal in an impedance (e.g. a resistor) having a second terminal common with the connector casings to establish a reference potential (e.g. ground) In this second relationship, the electrical connector forms a circuit which includes the moved probe, the impedance and the casing ground.

IN THE DRAWINGS

Figure 1:
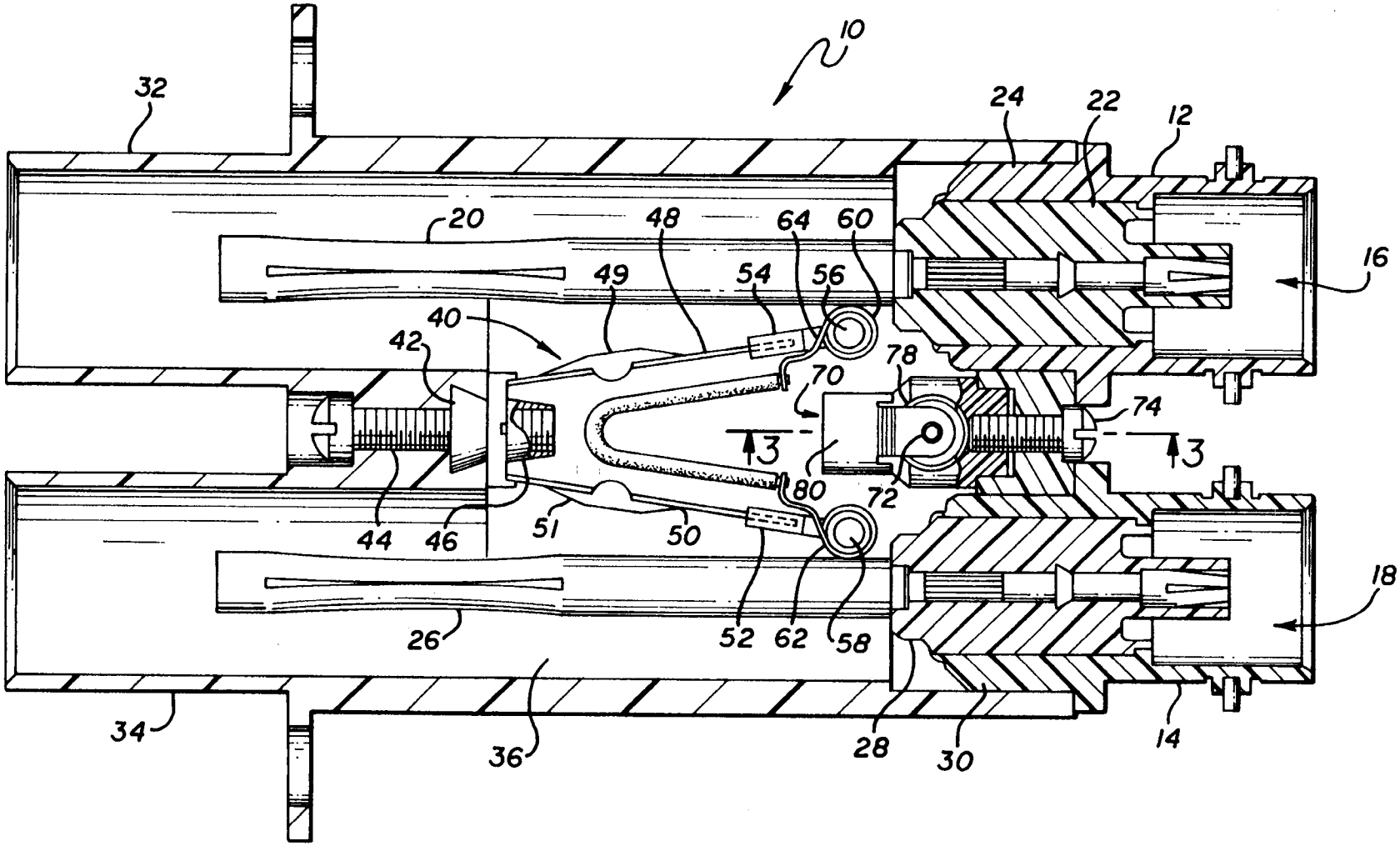
FIG. 1 is a view, partially in section, of a connector assembly forming one embodiment of the invention and shows the connector assembly in a first operative relationship.

In one embodiment of the invention, a housing generally indicated at 10 is provided with two (2) barrels 12 and 14 at one end. The barrel 12 is constructed to receive a connector generally indicated at 16. The barrel 14 is constructed to receive a connector generally indicated at 18. Each of the connectors 16 and 18 may be constructed in a conventional manner. For example, the connector 16 may include a centrally disposed probe 20, an insulator 22 enveloping the probe 20 in a coaxial relationship with the probe and a casing 24 enveloping the insulator in a coaxial relationship with the insulator. Similarly, the connector 18 may include a centrally disposed probe 26, an insulator 28 enveloping the probe 26 in coaxial relationship with the probe and a casing 30 enveloping the insulator 28 in coaxial relationship with the insulator.

The housing 10 also has barrel portions 32 and 34 at the opposite end of the housing from the barrel portions 12 and 14. The barrel portions 32 and 34 are spaced from the barrel portions 12 and 14 to define a cavity 36. A contact arrangement generally indicated at 40 is supported by the housing 10 in the cavity 36 at the end of the housing adjacent the barrel portions 32 and 34. The contact arrangement includes a post 42 which is attached to the housing as by a threaded screw 44 which extends into the housing at a position constituting a recess between the barrel portions 32 and 34. A nut 46 holds the post 42 in a fixed relationship on the screw 44 relative to the housing.

A pair of spring arms 48 and 50 extend into the cavity 36 from opposite ends of the post 42 in an outwardly flaring relationship. The spring arms 48 and 50 may be made from a suitable material such as beryllium copper to provide a low electrical resistivity. The spring arms 48 and 50 respectively carry insulating buttons 49 and 51 at an intermediate position along their lengths. The spring arms 48 and 50 terminate at positions respectively short of the probes 20 and 26. Insulating gloves 52 and 54 are fixedly disposed on the arms 48 and 50. The insulating gloves 52 and 54 respectively extend toward the probes 20 and 26 and respectively have bulbous portions 56 and 58 at their outer ends. Electrical conductors 60 and 62 are respectively disposed around the bulbous portions 56 and 58. The conductors 60 and 62 respectively have tails 64 and 66 which extend inwardly from the bulbous portions. An insulated lead 68 is attached at its outer ends to the tails 64 and 66.

An assembly generally indicated at 70 is provided for positioning an impedance such as a resistor 72 in a particular relationship to the bulbous conductive portions 60 and 62. The assembly 70 includes a screw 74 which extends through the housing in a recessed portion between the barrel portions 12 and 14. The screw 74 also extends through a hole in an electrical conductor 76 and into a threaded hole in an insulator 78. The conductor 76 may be shaped to receive a reference potential such as ground from the casings 24 and 30.

The resistor 72 extends through a hole in the insulator 78 in a direction transverse, preferably substantially perpendicular, to the screw 74 to hold the resistor 72 in fixed position. One terminal of the resistor 72 is common with the conductor 76. A conductive cap 80 extends from the ungrounded terminal of the resistor 72. Each of the conductors 60 and 62 is adapted to engage the conductive cap 80 when the associated one of the springs arms is moved from the unconstrained position shown in FIG. 1 to the constrained position shown in FIG. 2.

Figures 2, 3, 4:
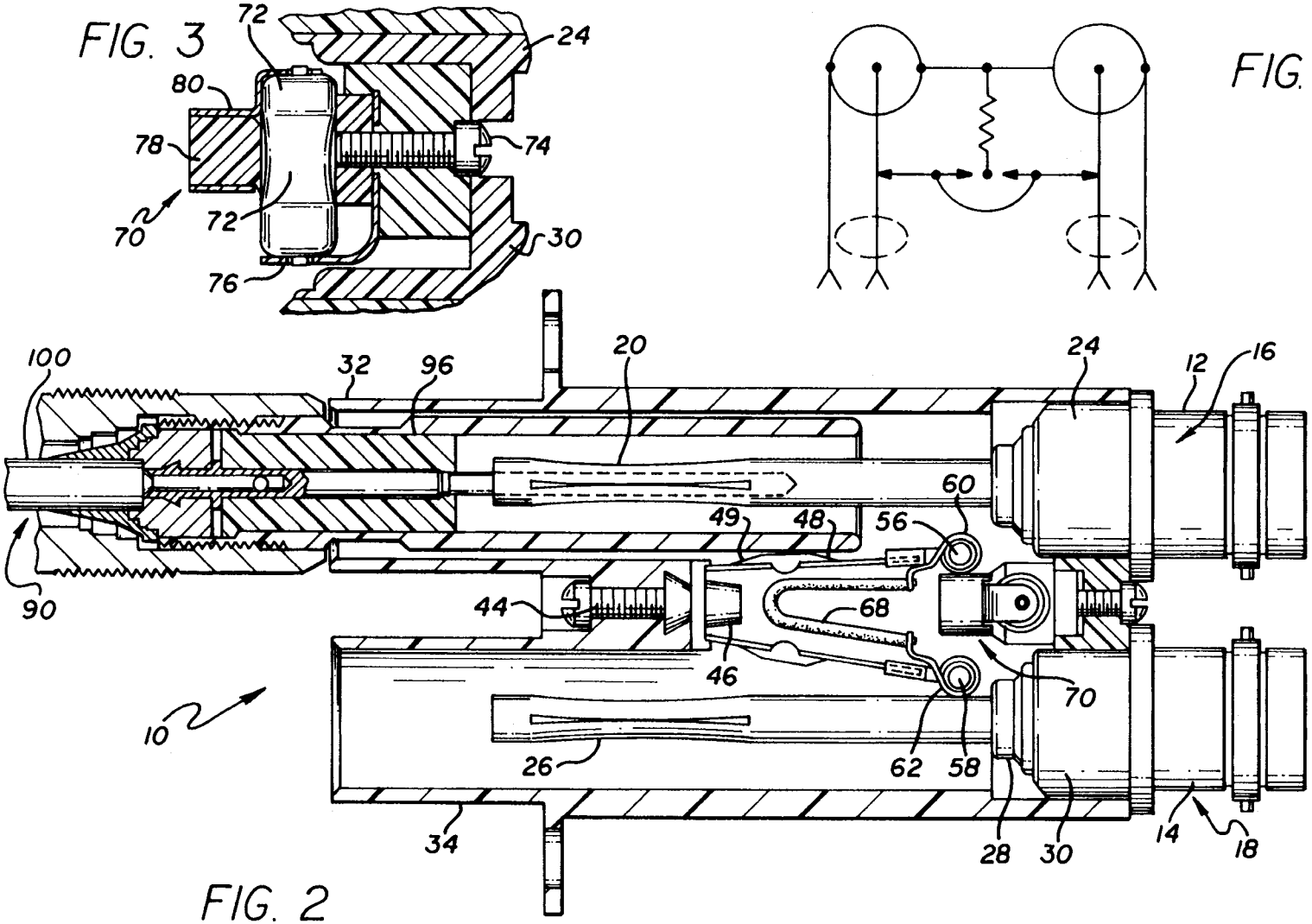
FIG. 2 is a view similar to that shown in FIG. 1 and illustrates the connector assembly in a second operative relationship and further shows a plug for operating upon the connector assembly to obtain the operation of the connector assembly in the second relationship.
FIG. 3 is a fragmentary sectional taken substantially on the line 3—3 of FIG. 1 and illustrates a sub-assembly of the connector assembly in additional detail.
FIG. 4 is an electrical circuit schematically illustrating the electrical operation of the connector assembly in the first and second operative relationships.

The barrels 32 and 34 are constructed to removably receive a plug generally indicated at 90 (FIG. 2). The plug may be made in a manner well known in the art. The plug 90 includes a casing 92, preferably annular, made from an electrically conductive material. The casing 92 is provided with a diameter to fit snugly in each of the barrels 32 and 34. A probe 100 is disposed within the casing 92 in concentric relationship with the casing and is isolated electrically from the casing as by an insulator 102 disposed between the casing and the probe. The probe 100 is adapted to engage either the probe 20 or the probe 26. It is shown in FIG. 2 as engaging the probe 20.

The spring arms 48 and 50 are normally biased so that the bulbous portion 60 engages the probe 20 and the bulbous portion 62 engages the probe 26. Since the bulbous portions 60 and 62 are connected by the insulated lead 68, the probes 20 and 26 are at a common potential. Furthermore, the casings 24 and 30 are at the reference potential such as ground. This causes the connectors 16 and 18 to be connected in series.

When it is desired to establish an electrical continuity between an individual one of the connectors 16 and 18 and the resistor 72, the plug 90 is then inserted into an individual one of the barrels 32 and 34. For example, the plug 90 may be inserted into the barrel 32 to engage the spring arm 48. The plug 90 is insulated from the spring arm 48 by the insulating button 49. The insertion of the plug 90 causes the spring arm 48 to move to a position where the conductor 60 engages the conductive cap 80. This causes a continuous circuit to be established which includes the probe 26, the conductive cap 80, the resistor 72, the conductor 76 and the casing 30. At the same time, a circuit can be established through the probe 100 between the probe 20 and the casing 24 in the connector 16. In like manner, a continuous circuit including the probe 20, the conductive cap 80, the resistor 72, the conductor 76 and the casing 24 is provided when the plug 90 is inserted into the barrel 34.

The connector shown in the drawings and described above has certain important advantages. This results from the shortening in the lengths of the spring arms 48 and 50. By shortening the lengths of the spring arms 48 and 50, the inductance of each of the spring arms is considerably reduced. The capacitance between each of the spring arms 48 and 50 and the associated one of the probes 20 and 26 is also minimized by shortening the lengths of the spring arms. This is especially significant at elevated frequencies such as frequencies in the order of hundreds of megahertz.

The connector assembly constituting this invention overcomes the disadvantages discussed above and is able to operate effectively at frequencies as high as approximately seven hundred and fifty megahertz (750 Mhz). The connector is able to operate effectively at these frequencies by respectively isolating the conductors 60 and 62 from the spring arms 48 and 50 and by connecting the conductors 60 and 62 as by the insulated leads 68. This minimizes any inductive or capacitive effects from the spring arms 48 and 50.

The connector assembly is also advantageous in transmitting digital information. A digital signal generally has rectangular characteristics. In order to transmit the digital signals faithfully, the harmonics at high frequencies have to be preserved. These harmonics effectively square the corners of the digital signals. The connector assembly of this invention is operative to pass the signals at the high frequencies.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

We claim:

1. In combination, a first connector having a first probe and a first casing, the first probe being disposed in coaxial and insulated relationship with the first casing, a second connector having a second probe and a second casing, the second probe being disposed in coaxial relationship with the second casing, the second casing being common with the first casing, electrically conductive means having first and second spring arms biased into engaged relationship with the first and second probes to establish a series relationship between the first and second connectors, first and second insulating means respectively disposed on the first and second spring arms of the electrically conductive means at the ends of these arms, first and second electrical contact means supported by the first and second insulating means for engaging the first and second probes in the engaged relationship of the electrically conductive means, and means for electrically connecting the first and second electrical contact means, an impedance having a first terminal disposed to establish an electrical circuit with the probe of an individual one of the connectors when the spring arm associated with such first terminal is moved to establish an electrical continuity between the associated contact means and such first terminal, the impedance having a second terminal common with the first and second connectors.

2. In a combination as set forth in claim 1, the first and second electrical contact means including first and second electrical conductors respectively disposed on the first and second insulating means and respectively movable with the first and second spring arms and further including an electrical lead connected to the first and second electrical conductors.

3. In a combination as recited in claim 2, the first and second insulating means respectively enveloping the first and second spring arms and the first and second electrical conductors respectively enveloping the first and second insulating means.

4. In a combination as recited in claim 1, the first and second spring arms terminating at a position short of the first and second probes and the first and second electrical contact means being respectively isolated electrically from the first and second spring arms, a first insulator disposed coaxially in the first connector between the first probe and the first casing, and a second insulator disposed coaxially in the second connector between the second probe and the second casing, the first probe extending beyond the first insulator and the first casing to provide for the engagement of the first probe by the first electrical contact means in the normally biased position of the first arm, the second probe extending beyond the second insulator and the second casing to provide for the engagement of the second probe by the second electrical contact means in the normally biased position of the second arm.

5. In combination, a connector having a casing, an insulator disposed within the casing in coaxial relationship with the casing and a probe disposed within the insulator in coaxial relationship with the casing and the insulator, a spring arm, insulating means at the end of the spring arm, an electrical conductor at the end of the insulating means, and an impedance normally displaced from the spring arm and having first and second terminals, the second terminal and the casing being at a common reference potential, means for supporting the spring arm in a normally biased disposition providing for an engagement between the electrical conductor and the probe, the spring arm being movable to a position where the electrical conductor engages the first terminal, and means for providing for the introduction of an electrical voltage to the probe in the normally biased position of the spring arm and for the introduction of an electrical voltage to the electrical conductor in the second position of the spring arm.

6. In a combination as recited in claim 5, an electrical lead connected between the electrical conductor and the providing means.

7. In a combination as set forth in claim 6, means for enveloping the casing of the connector and providing for the introduction of an actuator into the enveloping means to move the spring arm, the insulating means and the electrical conductor from the normally biased position to the second position where the electrical conductor engages the probe.

8. In a combination as set forth in claim 7, the providing means including a probe in a second electrical connector.

9. In combination, a connector having a casing, an insulator disposed within the casing in coaxial relationship with the casing and a probe disposed within the insulator in coaxial relationship with the insulator, a spring arm normally biased to a first position and movable to a second position, an impedance having first and second terminals, the second terminal of the resistor being common with the casing, electrically conductive means insulated from the spring arm and supported by the spring arm for movement with the spring arm to engage the probe in the first position of the spring arm and to engage the first terminal of the impedance in the second position of the spring arm, the impedance being displaced from the electrically conductive means in the first position of the spring arm, and means for introducing signals to the probe in the first position of the spring arm and for introducing signals to the electrically conductive means in the second position of the spring arm, the spring arm being shortened to receive the electrically conductive means, the electrically conductive means being constructed to provide for an introduction of signals at a higher frequency from the introducing means for passage through the impedance than if the electrically conductive means were not included and the spring arm extended to the first terminal of the impedance in the second position of the spring arm.

10. In a combination as recited in claim 9, means including a second connector having a second casing, a second insulator disposed within the second casing in co-axial relationship with the second casing and a second probe disposed within the second insulator in co-axial relationship with the second insulator, the spring arm constituting a first spring arm and the electrically conductive means constituting first electrically conductive means, a second spring arm normally biased to a first position, and movable to a second position, second electrically conductive means with the second spring arm in a relationship corresponding to the relationship between the first spring arm insulated from the second spring arm and supported by the second spring arm for movement with the second arm to engage the second probe in the first position of the second spring arm and to engage the first terminal of the impedance in the second position of the second spring arm, and means for providing an electrical continuity between the first and second electrically conductive means.

11. In a combination as recited in claim 9, the electrically conductive means including an insulator enveloping the spring arm and an electrical conductor enveloping the insulator.

12. In a combination as set forth in claim 9, the casing and the insulator being constructed to provide for an engagement between the first means and the probe in the first position of the spring arm.

13. In combination, first and second connectors each having a probe, an insulator enveloping the probe and a casing enveloping the insulator, electrically conductive means having first and second spring arms and having first and second electrical conductors respectively disposed on the spring arms in insulated relationship with the spring arms, the spring arms being normally biased for respective engagement of the first and second electrical conductors with the probes in the first and second connectors, an impedance displaced from the electrical conductors in the normally biased relationship of the spring arms and having first and second terminals, the spring arms being individually movable to a position in engagement with the first terminal of the impedance, a second terminal of the impedance being common with the casing, and means for applying signals to the individual ones of the probes in the connectors.

14. In a combination as set forth in claim 13, the electrical conductors having properties of passing signals at higher frequencies to the impedance from the individual ones of the probes than if the signals passed from the spring arms to the impedance.

15. In a combination as set forth in claim 13, the spring arms and the electrical conductors being disposed to minimize the inductance and capacitance produced in these members at frequencies in the range of hundreds of megahertz.

16. In a combination as set forth in claim 15, the electrically conductive means including the spring arms and also including insulating means disposed on the spring arms and further including the electrical conductors disposed on the insulating means and further including an electrical lead connecting the electrical conductors.

17. In combination for use with a plug, a housing having first and second barrels at one end of the housing and having third and fourth barrels at an opposite end of the housing, first and second connectors respectively disposed in the first and second barrels, each of the connectors having a probe, an insulator enveloping the probe in co-axial relationship with the probe and a casing enveloping, an impedance supported by the housing at a position between the first and second barrels, spring arms supported by the housing between the third and fourth barrels, electrical conductors supported by the spring arms in insulated relationship to the spring arms, the spring arms being normally biased for an engagement between the electrical conductors and the probes, the spring arms being movable into an engagement between the electrical conductors and the impedance upon an insertion of the plug into the third and fourth barrels, and means for electrically connecting the electrical conductors.

18. In a combination as set forth in claim 17, electrical insulators fixedly disposed upon the spring arms at the ends of the spring arms, the electrical conductors being fixedly disposed upon the electrical insulators.

19. In a combination as set forth in claim 18, the electrical insulators having bulbous portions at their ends, the electrical conductors being disposed on the bulbous portions of the insulators.

20. In a combination as recited in claim 19, the electrical conductors having first portions enveloping the bulbous portions of the electrical insulators, and the electrical conductors having tails extending from the first portions of the electrical conductors, and the means for electrically connecting the electrical conductors constituting an insulated lead connected to the tails.

21. In combination for use with a plug, a housing having first and second barrels spaced from each other at a first end of the housing and having third and fourth barrels spaced from each other at a second end of the housing opposite the first end, the housing defining a cavity between the first and second barrels and the third and fourth barrels, an impedance disposed in the housing cavity between the first and second barrels, in a direction transverse to the direction between the first and second barrels and the third and fourth barrels and transverse to the spacing between the first and second barrels and the spacing between the third and fourth barrels, a first electrical terminal connected to the impedance at one end of the impedance and a second electrical terminal connecting the impedance to the casing at the opposite end of the impedance, means including a pair of spring arms disposed in the housing cavity between the third and fourth barrels, electrical conductors disposed on the spring arms in insulated relationship to the spring arms, probes disposed in the cavity between the first and second barrels, the spring arms being normally biased to a first position providing an engagement between the electrical conductors and the probes and being movable to a second position providing an engagement between the electrical conductors and the first electrical terminal when the plug is inserted into the third and fourth barrels, and means for providing an electrical connection between the electrical conductors.

22. In a combination as recited in claim 21, the first and third barrels being aligned in the direction between such barrels, the second and fourth barrels being aligned in the direction between such barrels, and the impedance and the spring arm means being aligned in the direction between the first and third barrels.

23. In a combination as set forth in claim 22, insulators on the first and second spring arms at the movable ends of the spring arms, and the electrical conductors being disposed on the insulators.

24. In a combination as set forth in claim 23, the means for electrically connecting the electrical conductors constituting an electrical lead disposed between the spring arms and electrically connected at its opposite end to the electrical conductors.

* * * * *